US005357058A

United States Patent [19]

Tanihira et al.

[11] Patent Number: 5,357,058

[45] Date of Patent: Oct. 18, 1994

[54] RESIN-INSULATED CABLE

[75] Inventors: Kazuo Tanihira, Yachiyo; Hirofumi Yoshinaga, Tokyo, both of Japan

[73] Assignee: Fujikura Ltd., Tokyo, Japan

[21] Appl. No.: 57,709

[22] Filed: Jun. 23, 1993

Related U.S. Application Data

[62] Division of Ser. No. 624,708, Dec. 3, 1990, Pat. No. 5,223,062.

[51] Int. Cl.[5] ..... H01B 7/08; H01B 7/36

[52] U.S. Cl. ..... 174/112; 156/55; 174/110 FC; 174/117 F

[58] Field of Search ..... 174/110 FC, 112, 117 F; 156/51, 52, 53, 55

[56] References Cited

U.S. PATENT DOCUMENTS

| | | | |
|---|---|---|---|
| 2,911,328 | 11/1959 | Goldsmith | 427/118 X |
| 2,964,867 | 12/1960 | Kingsley et al. | 427/250 X |
| 2,998,332 | 8/1961 | Osdal et al. | 427/286 X |
| 3,011,916 | 12/1961 | Nicoll et al. | 427/393.5 |
| 3,018,188 | 1/1962 | Nicoll et al. | 427/256 |
| 3,071,486 | 1/1963 | Kingsley et al. | 427/271 |
| 3,085,912 | 4/1963 | Friese et al. | 427/56.1 |
| 4,029,006 | 6/1977 | Mercer | 118/624 X |
| 4,423,282 | 12/1983 | Suzuki et al. | 174/110 FC X |
| 4,443,657 | 4/1984 | Hill et al. | 156/55 X |
| 4,568,401 | 2/1986 | Davis | 156/56 X |
| 4,877,923 | 10/1989 | Sahakian | 174/110 FC X |
| 4,924,037 | 5/1990 | Ainsworth et al. | 156/55 X |
| 5,059,263 | 10/1991 | Sahakian et al. | 174/110 FC X |

FOREIGN PATENT DOCUMENTS

| | | | |
|---|---|---|---|
| 1-97908 | 8/1989 | Japan | 174/117 F |
| 2-94323 | 4/1990 | Japan | 174/117 F |
| 2-98013 | 4/1990 | Japan | 174/117 F |

*Primary Examiner*—Morris H. Nimmo
*Attorney, Agent, or Firm*—Helfgott & Karas

[57] ABSTRACT

A resin-insulated cable includes electrical conductors arranged in parallel with each other, two insulating resin tapes coating the conductors and a porous insulating resin tape faced with one of the insulating resin tapes and having a printed surface which is in contact with the one of the insulating resin tapes.

11 Claims, 6 Drawing Sheets

RESIN-INSULATED CABLE

CROSS-REFERENCE TO RELATED APPLICATION

This application is Rule 1.60 division of the application Ser. No. 624,708 filed Dec. 3, 1990 and now U.S. Pat. No. 5,223,062.

BACKGROUND OF THE INVENTION

The present invention relates to a resin-insulated cable such as a flat cable insulated by polytetrafluoroethylene resin and a method for manufacturing the same. More particularly, it relates to a resin-insulated cable in which characters or the like can be printed on the surface of a resin-coated layer to discriminate between cables or to find the positions of the electrical conductors of the cables, and a method for manufacturing the same.

A demand for flat cables each formed of a number of conductor wires arranged in parallel has recently been increased as electronic equipments are developed. Further, a heat resistance has been required in the fiat cables connected between the electronic equipments due to enhancement of the packed density of the electronic equipments. Since the polytetrafluoroethylene resin has a high heat resistance, the reliability of a flat cable including polytetrafluoroethylene resin serving as an insulating material is high. Since the dielectric constant of the polytetrafluoroethylene resin is low, the electrical characteristics of the flat cable are good. Further, the flat cable using the polytetrafluoroethylene resin can have mass termination at the distal end. Such a flat cable has lately attracted considerable attention.

The polytetrafluoroethylene resin is repellent to and non-wettable by water and oil, so it cannot be printed on by a common printing method. When the polytetrafluoroethylene resin is employed as an insulation coating material for flat cables, it is difficult to discriminate between conductors of the cables.

U.S. Pat. No. 2,998,332 discloses a printing method with ink formed by dispersing pigment and fluororesin in the form of colloid in a water solution. Using this ink, printing 10 can be performed as follows. Characters or symbols are written on a predetermined portion of the surface of a flat cable or coloring is applied thereto, and then the ink is attached to the cable by baking. Even though the surface of the polytetrafluoroethylene resin is coated with the ink, the surface repels the ink since its wettability is bad. Since the characters or symbols are printed by the mechanism in which ink is put on the surface of polytetrafluoroethylene, then melted and attached thereto, they may blur. Further, since the ink is suitable for printing straight lines but unsuitable for printing characters, small characters cannot be printed with the ink. Since the ink is fused in a baking process, very small characters, figures or symbols are difficult to print.

U.S. Pat. No. 3,018,188 discloses a technique of printing characters or a like by the hot stamp method in which the surface of ribbon coated with printing composition is transferred to the surface of the cable, using a stamp with a temperature of 327° C. or more. According to the hot stamp method, however, it is almost impossible to print the characters or the like on an uneven surface such as that of a flat cable.

SUMMARY OF THE INVENTION

An object of the present invention is to provide a resin-insulated cable which facilitates printing of small characters, and a method for manufacturing the same.

A resin-insulated cable according to an embodiment of the present invention comprises a plurality of electrical conductors arranged substantially in parallel. The conductors are coated with two insulating resin tapes so as to be interposed therebetween. A porous insulating resin tape is provided, which has at least one printed surface which is in contact with one of the insulating resin tapes.

A resin-insulated cable according to another embodiment of the present invention comprises an insulating resin tape and a porous insulating resin tape with which the conductors are coated so as to be interposed between them. The porous insulating resin tape has at least one printed surface.

A resin-insulated cable according to still another embodiment of the present invention comprises a conductor wire and a porous insulating resin layer coated on the conductor. The porous insulating resin layer has inner and outer surfaces on at least one of which printing is performed.

A method for manufacturing a resin-insulated cable according to an embodiment of the present invention comprises the steps of feeding two insulating resin tapes between which a plurality of conductor wires arranged substantially in parallel are interposed, feeding a porous insulating resin tape (at least one side of that surface has printed characters thereon), and pressing the insulating resin tapes and the porous insulating resin tape together by rollers, thereby forming a pressed form; and baking the pressed form.

A method for manufacturing a resin-insulated cable according to another embodiment of the present invention comprises the steps of feeding an insulating resin tape and a porous insulating resin tape (at least one side of the surface of the porous tape has printed characters thereon), arranging between the tapes a plurality of conductor wires substantially in parallel, and pressing the insulating resin tape and the porous insulating resin tape together by rollers, thereby forming a pressed form; and baking the pressed form.

A method for manufacturing a resin-insulated cable according to still another embodiment of the present invention comprises the steps of feeding between an insulating resin tape and a porous insulating resin tape a plurality of conductor wires arranged substantially in parallel, and pressing the insulating resin tape and the porous insulating resin tape together by rollers, thereby forming a pressed form; performing printing on a surface of the porous insulating resin tape; and baking the pressed form.

A method for manufacturing a resin-insulated cable according to still another embodiment of the present invention comprises the steps of coating a conductor with a porous insulating resin layer using a ram extrusion method; performing printing on a surface of the porous insulating resin layer; and baking the porous insulating resin tape.

A method for manufacturing a resin-insulated cable according to yet another embodiment of the present invention comprises the steps of wounding a porous insulating resin tape on a bare wire; performing printing on a surface of the porous insulating resin tape; and baking the porous insulating resin tape.

DETAILED DESCRIPTION OF THE PREFERRED EMBODIMENTS

Figure 1A:
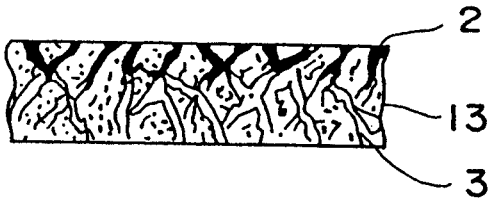
FIGS. 1A, 1B and 1C are schematic views for explaining the principle of the present invention.

As shown in FIG. 1A, when printing is performed on unbaked porous polytetrafluoroethylene tape 13 using ink 2 containing color pigment, ink 2 soaks into pores 3 of tape 13 in the transversal direction of the tape. Through the depth to which ink 2 soaks into depends on the form of the pores 3 and the amount of ink 2, the ink always penetrates to some depth from the printing surface of tape 13.

Figure 1B:
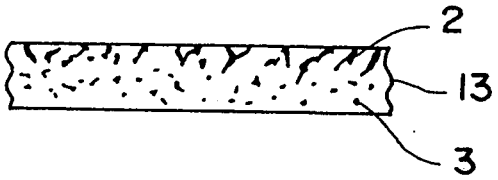

When tape 13 is compressed, as shown in FIG. 1B, the pores on the surface are broken and blocked and ink 2 is kept within tape 13. Ink 2 is thus trapped in tape 13.

Figure 1C:
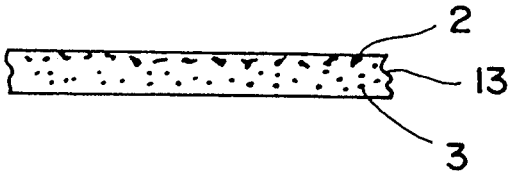

As illustrated in FIG. 1C, if tape 13 is baked at a temperature exceeding a predetermined baking temperature, pores 3 disappear, tape 1 is thinned, and ink 2 is kept inside tape 1. The printing is thus completed.

The inventors have found that characters, figures or the like can be printed on the surfaces of flat cables or round cables using the porous polytetrafluoroethylene resin tape to discriminate between the cables.

Figure 2:
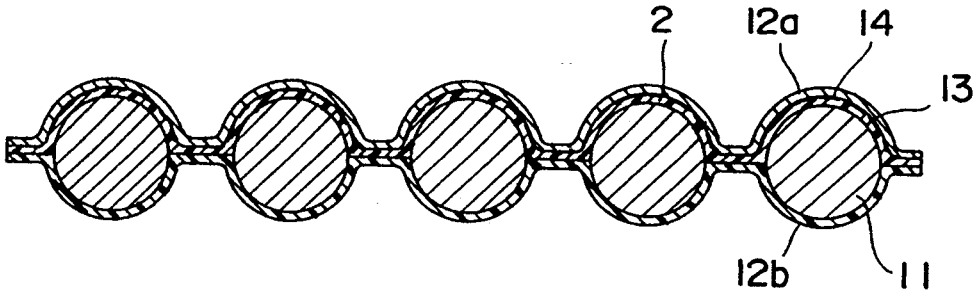
FIG. 2 is a cross-sectional view showing a flat cable according to the first embodiment of the present invention.

A resin-insulated cable according to the first embodiment of the present invention is formed as shown in FIG. 2. The resin-insulated cable has a plurality of electrical conductors 11 which are arranged in parallel, the conductors are coated with two polytetrafluoroethylene resin tapes **12*a* and 12*b* so as to be interposed therebetween. Each of conductors 11 is a copper wire plated with silver and has a diameter of, for example, 0.28 mm. Porous polytetrafluoroethylene resin tape 13 is provided on the inner surface of tape 12*a*, that is, between tape 12*a* on one hand and conductor wire 11 and tape 12*b* on the other hand. These tapes 12*a*, 12*b* and 13 are baked to adhere each other, and conductors 11 are buried and fixed between these tapes. As has been described above, characters, symbols, figures or the like are printed on surface 14 of tape 13, which overlaps tape 12*a*, and ink 2 is applied thereto (see FIG. 1). Since pores 3 of tape 13 are blocked and lost by the baking of tape 13, and ink (pigment) 2 infiltrating into pores 3 is sealed in the tape and completely shut off from outside by tape 12*a*, ink 2 cannot oxidize or decompose. Therefore, the characters, symbols, figures or the like printed on tape 13** can be discerned for a long time even in a high-temperature atmosphere.

Figure 3:
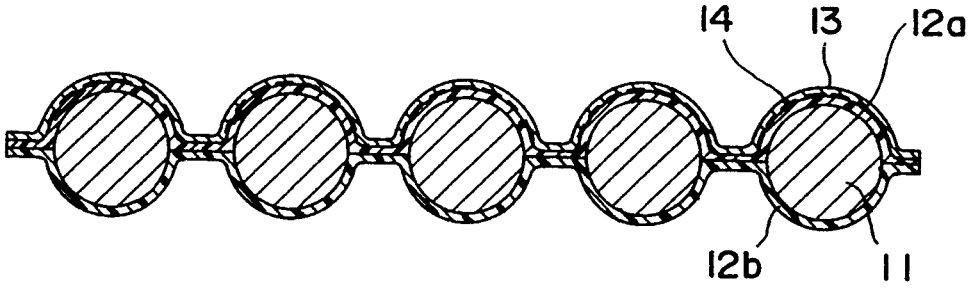
FIG. 3 is a cross-sectional view showing a flat cable according to the second embodiment of the present invention.

FIG. 3 shows a resin-insulated flat cable according to the second embodiment of the present invention. Porous polytetrafluoroethylene resin tape 13 on which characters or the like are printed, is formed on the outer surface of polytetrafluoroethylene resin tape **12*a*. Print surface 14 of tape 13 contacts the outer surface of tape 12*a*, and ink is applied to the print surface between tapes 13 and 12*a*** and completely shut off from the outside.

Figure 4:
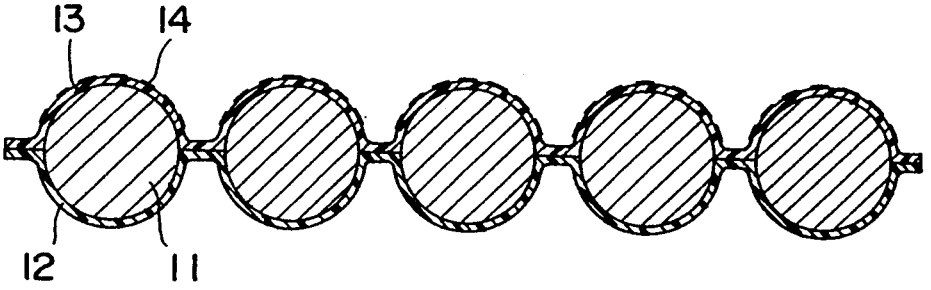
FIG. 4 is a cross-sectional view showing a flat cable according to the third embodiment of the present invention.

FIG. 4 illustrates a resin-insulated flat cable according to the third embodiment of the present invention. In this cable, conductor wires 11 are fixed between polytetrafluoroethylene resin tape 12 and porous polytetrafluoroethylene resin tape 13, characters or the like are printed on outer surface 14 of tape 13. In the third embodiment, tape 13 serves also as an insulation coating tape. Since the dielectric constant of polytetrafluoroethylene resin is low, its electrical characteristics are excellent. Even though the pigment of ink 2 is soaked into tape 13, the electrical characteristics of tape 13 are not degraded or any adverse influence is not exercised on the tape. In the third embodiment, print surface 14 is externally exposed. However, as shown in FIG. 1, pores 3 of tape 13 are compressed in the manufacturing process of the flat cable and blocked at the surface portion of the tape, and pores 3 disappear during the baking of tape 13 after the compression process. Ink 2 are thus sealed in pores 3 of tape 13. The use of tape 13 does not increase the thickness of an insulation coating portion so much, nor is it disadvantageous to formation of the cable in a narrow area. Print surface 14 can be formed at the outer surface of tape 13, as shown in FIG. 4, or it can be formed on the inner surface of the tape 13, which is put on tape 12. Further, print surface 14 can be formed on both surfaces of tape 13, and two insulation coating tapes can be constituted of tape 13.

The thickness of the flat cable according to the third embodiment is slightly thinner than that of the prior art flat cable, so that it is easy to form in a narrow space. Since the pigment is sealed and retained in tape 13, it will not be discolored or faded for a long time, nor will it be physically separated from the tape or worn out. Though tape 13 is porous in the printing process, pores 3 are completely sealed up by the burning of the tape and then lost; therefore, the insulation characteristics of the tape are not deteriorated.

The present invention includes a round cable on which printing is performed. A coating layer of insulating resin for coating one conductor wire is formed of porous resin such as polytetrafluoroethylene resin. Therefore, characters or the like can be clearly printed on the porous resin layer with ink in a better state.

The methods for manufacturing the resin-insulated flat cables according to the above first to third embodiments will be described.

Figure 5:
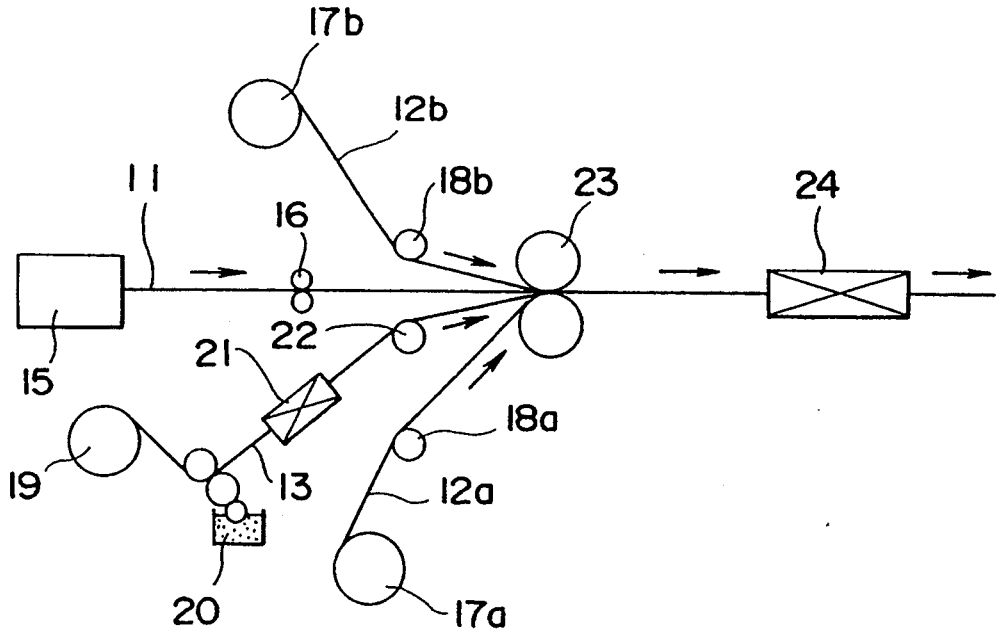
FIG. 5 is a schematic view showing a method of manufacturing the flat cable according to the first embodiment of the present invention.

FIG. 5 is a schematic view showing a method for manufacturing the flat cable according to the first embodiment (see FIG. 2). As shown in FIG. 5, conductors 11, which are arranged in parallel at predetermined intervals, are fed off from reel 15 and fed to heating/- pressing rollers 23 by guide rolls 16. Conductor wires 11 are, for example, copper wires each plated with silver having a diameter of 0.28 mm. Unbaked porous polytetrafluoroethylene resin tape 13, whose void is 20 to 40 wt % (the void is a ratio of the density of a porous tape to that of a solid tape) and whose compressibility is 15 to 40%, is fed off from reel 19 and supplied to drying furnace 21 through print means 20 of an offset printing machine or the like. Tape 13 is then supplied to rollers 23 by guide roll 22. Print means 20 performs printing on a predetermined surface of tape 13, and drying furnace 21 dries ink applied to tape 13.

Reel 17*a* is arranged below reel 19, and reel 17*b* is arranged above reel 15, and unbaked polytetrafluoroethylene resin tapes 12*a* and 12*b* are fed off from reels 17*a* and 17*b*, respectively. Tapes 12*a* and 12*b* are fed to rollers 23 through guide rolls 18*a* and 18*b* so as to interpose conductors 11 and tape 13 therebetween. Tapes 12*a*, 12*b* and 13 are heated up to 90° C. and pressed by rollers 23 and firmly stuck onto one another and also onto the surface of conductors 11. Thus conductors 11 are integrally formed between tapes 12*a* and 13 and tape 12*b*, and a resin-insulated tape is supplied into baking furnace 24 by these tapes. Polytetrafluoroethylene resin is heated in furnace 24 at a temperature of, e.g., 370° to 400° C. which exceeds a baking temperature of polytetrafluoroethylene resin. Since tapes 12*a*, 12*b* and 13 are integrally formed in contact with each other in the baking process, a flat cable is obtained which is uniformly shrunk. The flat cable as shown in FIG. 2 can thus be manufactured only by supplying porous resin tape 13 between tapes 12*a* and 12*b* and the flat cable, which facilitates printing, can be easily manufactured without any additional manufacturing process.

To manufacture the flat cable shown in FIG. 3, porous resin tape 13 is supplied to the outside of polytetrafluoroethylene resin tape 12*a*.

Figure 6:
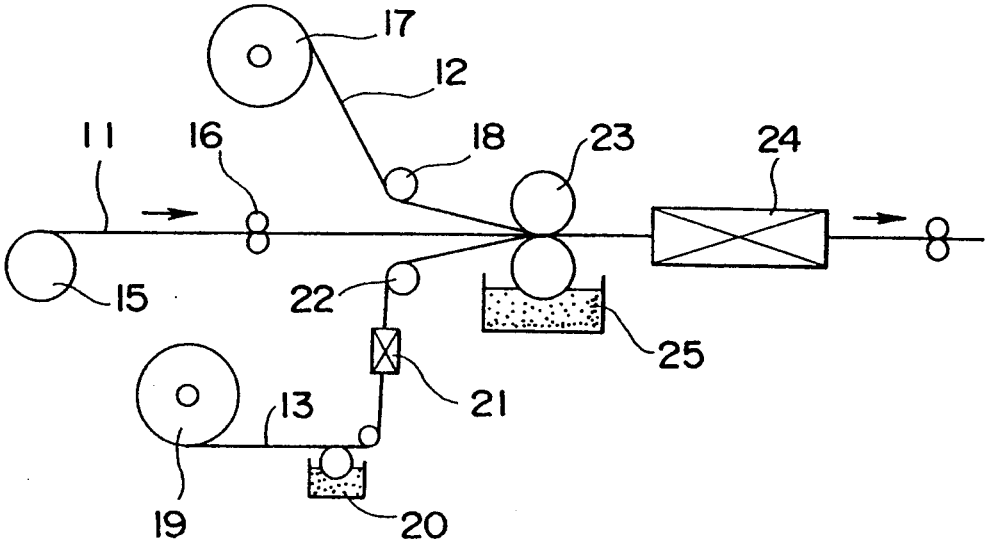
FIG. 6 is a schematic view showing a method for manufacturing the flat cable according to the second embodiment of the present invention.

A method for manufacturing the flat cable according to the second embodiment will be described with reference to FIG. 6. A plurality of conductors 11, which are, for example, silvered copper wires each having a diameter of 0.28 mm, are fed off from reel 15 and fed to heating/pressing rollers 23 through guide roll 16. Reel 19 on which a roll of unbaked porous polytetrafluoroethylene resin 13 (whose void is 20 to 40 wt %) is mounted, is arranged below reel 15. Porous resin tape 13 is fed off from reel 19 and supplied to rollers 23 by guide roll 22. Print means 20 of an offset printing machine or the like and drying oven 21 are arranged between reel 19 and rollers 23. Print means 20 performs a predetermined printing on tape 13, and drying furnace 24 dries ink applied to the tape. Further, polytetrafluoroethylene resin tape 12 is fed off from reel 17 arranged above reel 15 and supplied to rollers 23 through guide roll 18. In rollers 23, conductor wires 11 are thus interposed between tapes 12 and 13 and wrapped therein. Tapes 12 and 13 are heated and molded by rollers 23, and they are firmly stuck onto each other and also onto the surfaces of conductors 11. Thus tapes 12 and 13 are integrally formed with conductor wires 11, then supplied to baking furnace 24. Tank 25 may be provided, if necessary. Tank 25 is intended to eliminate ink which oozes from tape 13 and then adheres to rollers 23 when the tapes are pressed.

In furnace 24, an insulated cable of polytetrafluoroethylene resin is heated at a temperature of, e.g., 370 ° to 400° C. exceeding the baking temperature of polytetrafluoroethylene resin.

Since tapes 12 and 13 are firmly stuck to each other with conductors 11 interposed therebetween and the tapes are integrally formed with the conductors, a flat cable can be formed without any non-uniform shrinkage. Ink is infiltrated into the pores of tape 13 and shut off from outside since the pores are sealed up by pressing and baking the printed surface 14 of tape 13. The ink is thus prevented from being oxidized to decompose therefore, characters or the like printed on the tape can be discriminated for a long time.

Figure 7:
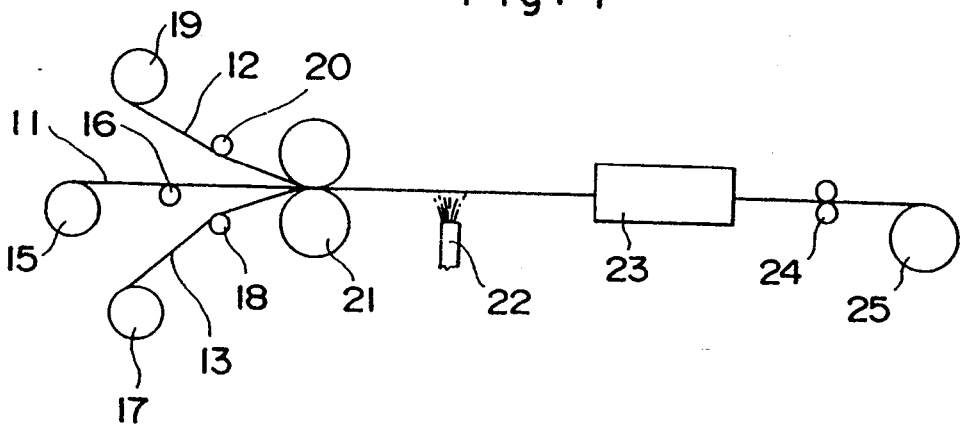
FIG. 7 is a schematic view showing a method for manufacturing tile flat cable according to the third embodiment of the present invention.
Figure 8A:
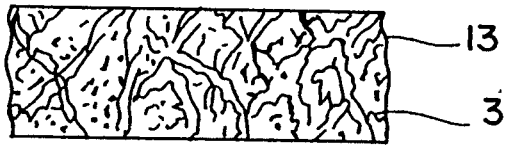
FIG. 8 is a schematic view showing the principle of the manufacturing method shown in FIG. 7.
Figure 8B:
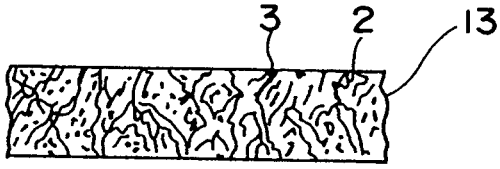

A method for manufacturing the flat cable according to the third embodiment will be described with reference to FIG. 7. In FIG. 7, a plurality of conductors 11, polytetrafluoroethylene resin tape 12, and unbaked porous polytetrafluoroethylene resin tape 13 are fed off from reels 15, 19 and 17, respectively, and they are supplied to heating/pressing rollers 21 through guide rolls 16, 20 and 18, respectively. Tape 13 has a number of pores 3 communicating with one another in all directions, as shown in FIG. 8A. Tapes 12 and 13 are heated and pressed with conductor wires 11 interposed therebetween and brought into contact with each other. Therefore, a resin-insulated flat cable having a plurality of conductor wires 11 arranged in parallel and interposed between tapes 12 and 13, can be obtained. Tape 13 is pressed by rollers 21 and its thickness is reduced, but its porosity is not lost. Even if tape 13 having a thickness of 0.31 mm is pressed by rollers 21, and the thickness is decreased to 0.25 mm, the tape has porosity of 25%. As shown in FIG. 8B, tape 13 is thinned, but doesn't lose porosity.

Figure 8C:
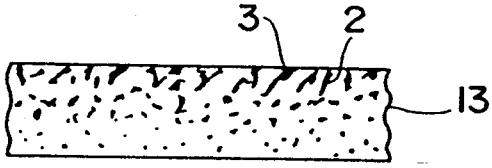

Ink jet printer 22 jets ink to tape 13, and the ink soaks into the pores of the tape. As illustrated in FIG. 8C, ink 2 soaks into pores 3 of tape 13 in the inward direction of the tape. Marks such as predetermined characters and symbols are printed on tape 13.

Figure 8D:
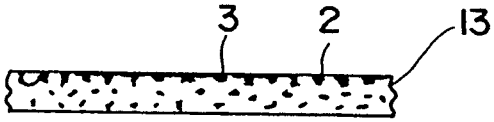

Tapes 12 and 13 and conductors 11, which are integrally formed, are guided into baking furnace 23. In this furnace, the tapes are heated at a temperature of, e.g., 370 ° to 400° C. exceeding the baking temperature of polytetrafluoroethylene resin. Tapes 12 and 13 are integrally fixed onto each other with being uniformly shrunk. Thus the tapes are baked, and, as shown in FIG. 8D, almost all the pores of tape 13 are lost, then the tape is uniformly shrunk, and ink 2 is completely shut off. More specifically, the pores of tape 13 are broken with ink infiltrated into the pores, and the ink is sealed in tape 13. The ink is completely shut off from outside the tape and thus prevented from being oxidized. The marks printed on the tape can thus be discriminated for a long time, and the tapes sufficiently function as insulation coating layers. While tape 13 is porous, tape 12 is either solid or porous.

In this embodiment, when tape 13 is pressed and formed by heating/pressing rollers 21, ink does not adhere to the tape. Even though tape 13 is pressed by rollers 21, the pigment of the ink does not ooze from the tape, nor does it contaminate the rollers 21. Since printing is performed by ink jet printer 22 after tapes 12 and 13 are stuck and pressed to each other, an area for the printing can be conformed with a predetermined position with high precision.

Figure 9:
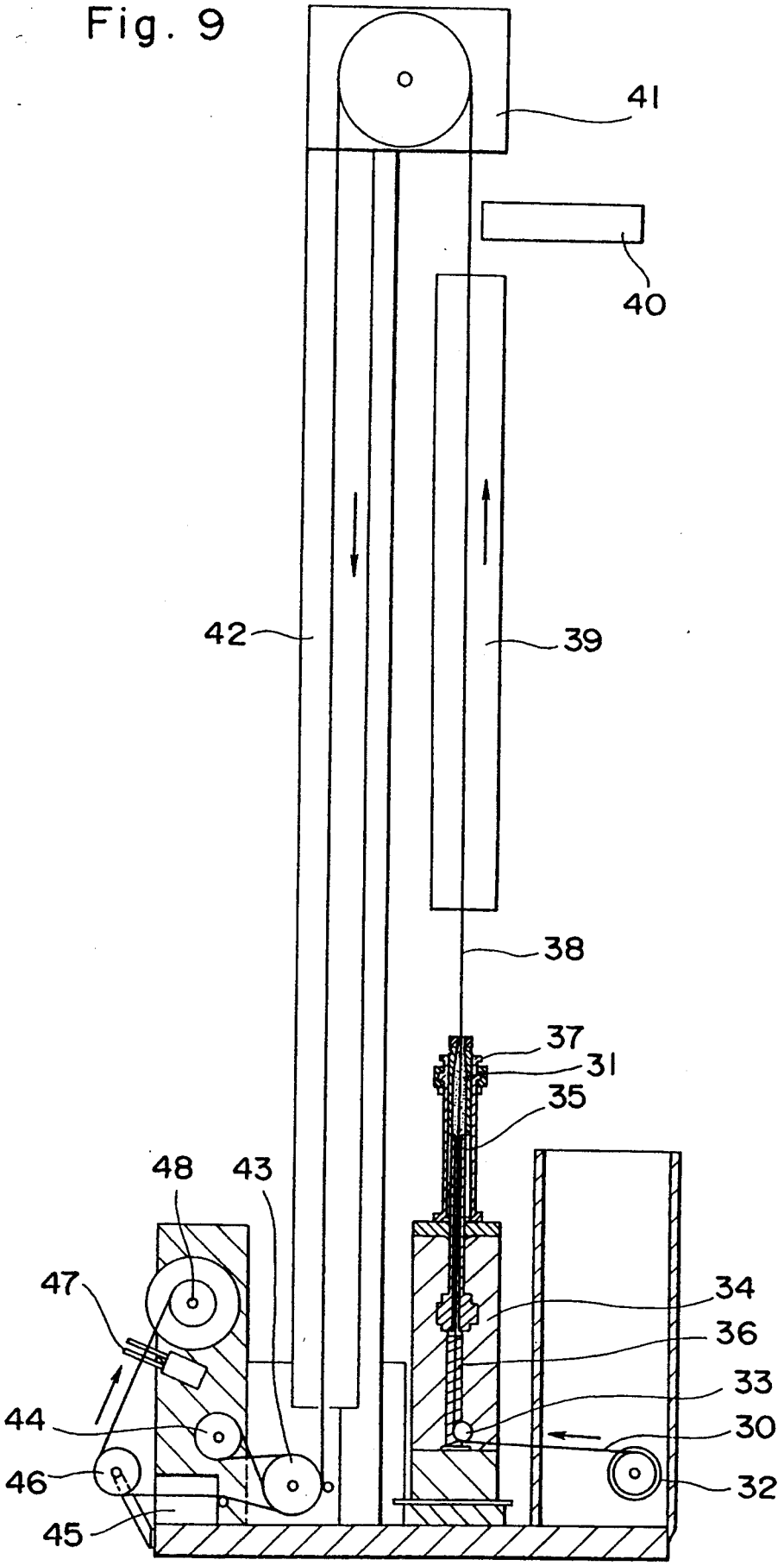
FIG. 9 is a front view showing a method for manufacturing a single resin-insulated cable according to the fourth embodiment of the present invention.

A method for manufacturing a single resin-insulated cable using a ram extrusion method according to the fourth embodiment of the present invention will be described. FIG. 9 is a front view showing the fourth embodiment. Conductor 30 made of copper or the like is wound around wire reel 32. Conductor 30 rises from reel 33 to reel 41. During the rising, the conductor 30 is coated with insulation material in resin material feed section 31. Ram 35 is pushed up by rotation of lead screw 36 in mold 34 and extrudes insulation material onto conductor 30. Coated conductor 38 is pushed away from die 37 arranged at the upper portion of mold 34. The coated conductor 38 is then dried by drying furnace 39. Ink jet printer 22 is provided above drying furnace 39 and performs printing characters to the coated conductor 38. After the printing, the coated conductor is inverted by reel 41 and falls down to reel 43. In this process, coated conductor 38 is heated and baked in furnace 42. The coated conductor is then wound by wire reeler 48 through reel 43, reel 44, reel 43, and reel 46. Guide 47 stands between reels 46 and 48 to arrange the conductor on reel 48.

In this device, ink jet printer 40 is added to the ordinary ram extrusion apparatus. As described above, conductor 30 is supplied from reel 32 and coated with resin material in feed section 31. The coated conductor 38 is extruded through die 37. The resin material is semi-solidified material obtained by blending an assistant (naphtha) with resin powder and then aging the blended assistant and powder. If resin material is heated in drying furnace 39, the naphtha is evaporated and lost, and the resin layer becomes porous. If ink jet printer 40 jets ink to the resin layer, the ink soaks into the pores of the resin layer and printing is performed as has been described above. Then the resin layer is baked in furnace 42, the pores are lost, and the ink is sealed in the resin layer. Similarly, in the fourth embodiment, a resin-coated conductor on which printing is performed with high resolution can be obtained.

In the fourth embodiment, the resin-insulated cable is formed by the ram extrusion method. However, a resin-insulated cable in which an electrical conductor is coated with resin can be formed by winding the porous resin tape around a bare wire, printing characters or the like on the resin tape, and burning the tape.

Figure 10:
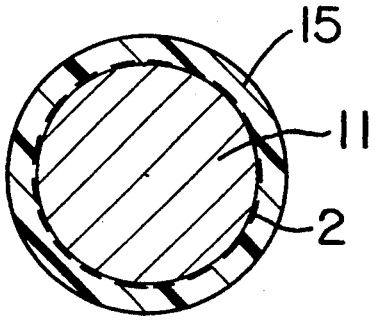
FIGS. 10 and 11 show a resin-insulated cable in which a porous insulating resin coated on a conductor wire has printing performed on the inner surface thereof and the outer surface thereof, respectively.
Figure 11:
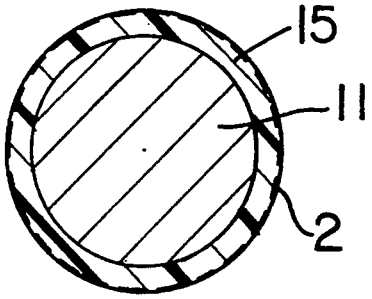

FIGS. 10 and 11 each show a conductor wire 11 of which the outer surface is covered by a porous insulating resin layer 15. FIG. 10 shows an embodiment of the cable wherein the inner surface of layer 15 is soaked with ink 2 and is in contact with the outer surface of the wire 11, while FIG. 11 shows an embodiment of the cable wherein ink 2 is soaked and sealed in the outer surface of the porous insulating layer 15.

What is claimed is:

1. A resin-insulated cable comprising:

a plurality of electrical conductors arranged substantially in parallel;

two insulating resin tapes with which said conductors are coated so as to be interposed therebetween; and a pressed and baked porous insulating resin tape faced with one of said insulating resin tapes and having on at least one surface thereof ink printed characters so that ink of said characters penetrated into pores of said porous insulating resin tape is sealed therein, said at least one surface being in contact with said one insulating resin tape.

2. The resin-insulated cable according to claim 1, wherein said porous insulating resin tape is arranged between said two insulating resin tapes, and said at least one surface of said porous insulating resin tape is brought into contact with an inner surface of said one insulating resin tape.

3. The resin-insulated cable according to claim 1, wherein said porous insulating resin tape is arranged on one of said insulating resin tapes and said at least one surface of said porous insulating resin tape is brought into contact with an outer surface of said one insulating resin tape.

4. A resin-insulated cable comprising:

a plurality of electrical conductors arranged substantially in parallel; and an insulating resin tape and a porous insulating resin tape with which said conductors are coated so as to be interposed therebetween, said porous insulating resin tape being a pressed and baked porous resin tape having on at least one surface thereof ink printed characters so that ink penetrated into pores of said porous insulating resin tape is sealed therein.

5. A resin-insulated cable comprising:

a conductor wire; and a pressed and baked porous insulating resin layer coated on said conductor wire to surround the same and having on at least one of inner and outer surfaces thereof ink printed characters so that ink penetrated into pores of said porous insulating resin layer is sealed therein.

6. The resin-insulated cable according to claim 1, wherein said insulating resin tape is a polytetrafluoroethylene tape.

7. The resin-insulated cable according to claim 4, wherein said insulating resin tape is a polytetrafluoroethylene tape.

8. The resin-insulated cable according to claim 5, wherein said insulating resin tape is a polytetrafluoroethylene tape.

9. The resin-insulated cable according to claim 1, wherein said porous insulating resin tape is a polytetrafluoroethylene tape.

10. The resin-insulated cable according to claim 4, wherein said porous insulating resin tape is a polytetrafluoroethylene tape.

11. The resin-insulated cable according to claim 5, wherein said porous insulating resin tape is a polytetrafluoroethylene tape.

* * * * *